US008044897B2

(12) United States Patent
Huang

(10) Patent No.: US 8,044,897 B2
(45) Date of Patent: Oct. 25, 2011

(54) LIGHT SOURCE CONTROL APPARATUS

(75) Inventor: Chun-Yi Huang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 1003 days.

(21) Appl. No.: 11/766,801

(22) Filed: Jun. 22, 2007

(65) Prior Publication Data

US 2008/0224967 A1 Sep. 18, 2008

(30) Foreign Application Priority Data

Mar. 16, 2007 (TW) ..... 96109060 A

(51) Int. Cl.
*G09G 3/32* (2006.01)

(52) U.S. Cl. ..... 345/82; 348/175

(58) Field of Classification Search ..... 345/77–90; 348/175–179

See application file for complete search history.

(56) References Cited

U.S. PATENT DOCUMENTS 4,820,023 A * 4/1989 Ohsawa ..... 396/301
5,861,830 A * 1/1999 Cheng et al. ..... 341/135
7,317,403 B2 * 1/2008 Grootes et al. ..... 340/815.45
7,515,148 B2 * 4/2009 Lee ..... 345/204
2006/0007248 A1 * 1/2006 Reddy et al. ..... 345/690
2006/0007249 A1 * 1/2006 Reddy et al. ..... 345/690
2006/0087247 A1 * 4/2006 Malmberg ..... 315/169.2
2006/0092183 A1 * 5/2006 Malmberg ..... 345/690

* cited by examiner

*Primary Examiner* — Amare Mengistu
*Assistant Examiner* — Vinh Lam
(74) *Attorney, Agent, or Firm* — Jianq Chyun IP Office

(57) ABSTRACT

A light source control apparatus and a method for controlling light source are provided. The light source control apparatus is used to controlling N light-emitting devices connected in series. N+1 nodes are sequentially defined at two terminals of each light-emitting device mentioned above, where N is a natural number. The light source control apparatus includes a testing circuit and a compensation circuit. The testing circuit is coupled to the nodes to transmit a testing current to light-emitting devices between Ith node and Jth node, where I and J are natural numbers, and N+1>=J>I>=1. The compensation circuit is coupled to the nodes to measure a brightness of light-emitting devices between Ith node and Jth node, decide a value of a compensation current according to an intensity of the brightness, and provide the compensation current to light-emitting devices between Ith node and Jth node.

13 Claims, 9 Drawing Sheets

LIGHT SOURCE CONTROL APPARATUS

CROSS-REFERENCE TO RELATED APPLICATION

This application claims the priority benefit of Taiwan application serial no. 96109060, filed Mar. 16, 2007. All disclosure of the Taiwan application is incorporated herein by reference.

BACKGROUND OF THE INVENTION

1. Field of the Invention

The present invention relates to a control apparatus and method. More particularly, the present invention relates to a light source control apparatus and a method for controlling a light source.

2. Description of Related Art

RGB light emitting diodes (LEDs) can exhibit a wider color gamut as compared with cold cathode fluorescent lamps (CCFLs), wherein R, G, B are red, green, and blue signals of three primary colors. Therefore, LED has a more diversified color performance than the CCFL, and has been widely used as light-emitting sources of liquid crystal displays (LCD).

However, since the size of the LCDs is increasingly enlarged, and the number of the LEDs used in an LCD of a larger size usually reaches several hundreds. Therefore, the LEDs in the LCD are usually connected in series or in parallel, so as to reduce the number of parts for controlling the LEDs. However, this control method may degrade the quality of images, as shown in FIG. 1.

FIG. 1 shows a conventional LED control apparatus disposed in the LCD. The LED control apparatus is used to control the light-emitting brightness of the LEDs 101-10N, and the LEDs 101-10N are a string of LEDs connected in series in the LCD. The control apparatus in the figure includes a brightness measuring circuit 100-1 having a photosensitive diode 100-2, an analog-digital converter 100-3, a control circuit 100-4, a power metal-oxide-semiconductor (MOS) transistor 100-5, and a resistor 100-6. Moreover, a source voltage and a common level are respectively indicated by VCC and COM.

The conventional control device uses a resistor 100-6 to obtain a feedback signal FB, so as to make the feedback signal FB tracking a reference voltage VFB in the control circuit 100-4 to generate a pulse width modulation signal PWM to control the tuning on of the power MOS transistor 100-5, so that the current passing through the resistor 100-6 is I=VFB/resistor 100-6. According to Kirchhoff's current law (KCL), the current will also pass through the LEDs 101-10N. The spectrum emitted by the LEDs are measured through the brightness measuring circuit 100-1, and converted into a digital signal by using the analog-digital converter 100-3, and then transmitted to the control circuit 100-4, so that the control circuit 100-4 can adjust the LEDs to the desired spectrum range according to the pulse width modulation signal PWM.

However, the temperature coefficients and degrees of aging of the LEDs are not completely identical, so that the light-emitting situation of each LED varies, and the circuit architecture of the conventional control apparatus can not adjust the LED individually, thus degrading the image quality of LCDs.

Moreover, as the conventional architecture can only amend the brightness of the LEDs 101-10N at the same time, and the brightness compensation can not be performed on an individual LED, the image quality is degraded. Therefore, a strict quality control is necessary for mass production, and the manufacturing cost remains high, and the quality is still difficult to control.

SUMMARY OF THE INVENTION

The present invention is directed to providing a light source control apparatus, capable of compensating a brightness of a single LED or a plurality of LEDs connected in series, such that an image quality of the LCDs is stabilized and a stringent quality control is not required in mass production of LCDs, thereby reducing the manufacturing cost.

The present invention is directed to a light source control method, which can compensate the brightness of a single LED or a plurality of LEDs connected in series, such that the image quality of the LCDs is stabilized and a stringent quality control is not required in mass production of LCDs, thereby reducing the manufacturing cost.

As embodied and broadly described herein, the present invention provides a light source control apparatus. The light source control apparatus is employed for controlling N light-emitting devices connected in series. N+1 nodes are sequentially defined at two terminals of each light-emitting device, where N is a natural number. The light source control apparatus includes a testing circuit and a compensation circuit. The testing circuit is coupled to the above nodes to transmit a testing current to light-emitting devices between Ith node and Jth node, where I and J are natural numbers, and N+1>=J>I>=1. The compensation circuit is also coupled to the above nodes to measure the brightness of the light-emitting devices between the Ith node and the Jth node, determine the value of the compensation current according to the intensity of the above brightness, and provide the compensation current to the light-emitting devices between the Ith node and the Jth node.

As embodied and broadly described herein, the present invention provides a method of controlling a light source. The method is employed to control N light-emitting devices connected in series. N+1 nodes are sequentially defined at two terminals of each light-emitting device, where N is a natural number. The method includes first transmitting a testing current to light-emitting devices between Ith node and Jth node, where I and J are natural numbers and N+1>=J>I>=1. Then, the brightness of the light-emitting devices between the Ith node and the Jth node is measured. Next, the value of the compensation current is determined according to the intensity of the above brightness. Finally, the above compensation current is provided to the light-emitting devices between the Ith node and the Jth node.

In an embodiment of the present invention, the above compensation circuit includes a brightness measuring circuit, a control circuit, and a compensation unit. The brightness measuring circuit is used to measure the brightness of the light-emitting devices between the Ith node and the Jth node, so as to generate a brightness indication signal. The control circuit determines the value of the compensation current according to the brightness indication signal, and outputs a first compensation signal and a second compensation signal according to the value of the compensation current. The compensation unit is coupled to the above nodes for transmitting the above compensation current to the light-emitting devices between the Ith node and the Jth node according to the first compensation signal, and sinking the compensation current flowing to the Jth node according to the second compensation signal.

In the light source control apparatus according to the above embodiment, the above compensation unit includes a plurality of digital-analog converting units, a plurality of first switches, and a plurality of second switches. Each digital-analog converting unit has an input terminal, an output terminal, and a sink terminal. The input terminal of each digital-analog converting unit is coupled to the control circuit, and the magnitude of the compensation current output by the output terminal and the magnitude of the current sunk by the sink terminal are determined according to the signal received by the input terminal. Each of the above first switches has a first terminal, a second terminal, and a control terminal. The first terminals of the first switches are respectively coupled to the output terminals of the digital-analog converting units, the second terminals of the first switches are respectively coupled to the above nodes, and the control terminals of the first switches are coupled to the control circuit, and the on or off state of the first switches is determined according to the signal received by the control terminals. Each of the above second switches has a first terminal, a second terminal, and a control terminal. The first terminals of the second switches are respectively coupled to the sink terminals of the digital-analog converting units, the second terminals of the second switches are respectively coupled to the above nodes, and the control terminals of the second switches are coupled to the control circuit, and the on or off state of the second switches is determined according to the signal received by the control terminals. The input terminals of two of the digital-analog converting units respectively receive the first compensation signal and the second compensation signal, the first switch corresponding to the digital-analog converting unit employed for receiving the first compensation signal is turned on, and the second switch corresponding to the digital-analog converting unit for receiving the second compensation signal is turned on.

In another embodiment of the present invention, the above compensation circuit includes a brightness measuring circuit, a control circuit, and a compensation unit. The brightness measuring circuit is employed to measure the brightness of the light-emitting devices between the Ith node and the Jth node, so as to generate a brightness indication signal. The control circuit determines a value of the compensation current according to the above brightness indication signal, and outputs a compensation signal according to the value of the compensation current. The compensation unit is coupled to the above nodes for transmitting the above compensation current to the light-emitting devices between the Ith node and the Jth node, and sinking the compensation current flowing to the Jth node according to the compensation signal.

In the light source control apparatus according to another embodiment, the above compensation unit includes a digital-analog converting unit, a plurality of fifth switches, and a plurality of sixth switches. The digital-analog converting unit has an input terminal, an output terminal, and a sink terminal. The input terminal of the digital-analog converting unit receives the compensation signal, so as to determine the magnitude of the compensation current output by the output terminal and the magnitude of the current sunk by the sink terminal. Each of the above fifth switches has a first terminal, a second terminal, and a control terminal, the first terminals of the fifth switches are respectively coupled to the output terminal of the digital-analog converting unit, the second terminals of the fifth switches are respectively coupled to the above nodes, and the control terminals of the fifth switches are coupled to the control circuit, and the on or off state of the fifth switches is determined according to the signal received by the control terminals. Each of the above sixth switches has a first terminal, a second terminal, and a control terminal. The first terminals of the sixth switches are respectively coupled to the sink terminal of the digital-analog converting unit, the second terminals of the sixth switches are respectively coupled to the above nodes, and the control terminals of the sixth switches are coupled to the control circuit, and the on or off state of the sixth switches is determined depending on the signal received by the control terminals. The fifth switch coupled to the Ith node is turned on, and the sixth switch coupled to the Jth node is turned on, In an embodiment of the present invention, the above digital-analog converting unit includes a digital-analog converter, a first current mirror apparatus, and a second current mirror apparatus. The digital-analog converter has an input terminal and an output terminal, and the digital-analog converter determines the magnitude of the current output by the output terminal according to the signal received by the input terminal. The first current mirror apparatus has a first terminal, a second terminal, a third terminal, a fourth terminal, a fifth terminal, and a sixth terminal. The first terminal of the first current mirror apparatus receives the current output by the digital-analog converter. The first current mirror apparatus determines a value of the current of the third terminal and the fourth terminal and a value of the current of the fifth terminal and the sixth terminal according to the current flowing through the first terminal and the second terminal. The fifth terminal of the first current mirror apparatus is used as the sink terminal of the digital-analog converting unit. The second current mirror apparatus has a first terminal, a second terminal, a third terminal, and a fourth terminal. The second terminal of the second current mirror apparatus is coupled to the third terminal of the first current mirror apparatus, and the fourth terminal of the second current mirror apparatus is used as the output terminal of the digital-analog converting unit. The second current mirror apparatus determines a value of the current of the third terminal and the fourth terminal according to the current flowing through the first terminal and the second terminal.

In an embodiment of the present invention, the above first current mirror apparatus includes a first NMOS transistor, a second NMOS transistor, and a third NMOS transistor. The first NMOS transistor has a drain and a gate connected to the drain. The drain of the first NMOS transistor is employed as the first terminal of the first current mirror apparatus, and a source of the first NMOS transistor is used as the second terminal of the first current mirror apparatus, and coupled to a common level. The second NMOS transistor has a drain used as the third terminal of the first current mirror apparatus, a source used as the fourth terminal of the first current mirror apparatus and coupled to a common level, and a gate coupled to the gate of the first NMOS transistor. The third NMOS transistor has a drain used as the fifth terminal of the first current mirror apparatus, a source used as the sixth terminal of the first current mirror apparatus and coupled to a common level, and a gate coupled to the gate of the first NMOS transistor.

In the light source control apparatus according to the above embodiment, the above second current mirror apparatus includes a first PMOS transistor and a second PMOS transistor. The first PMOS transistor has a drain and a gate connected to the drain. A source of the first PMOS transistor is used as the first terminal of the second current mirror apparatus and coupled to a source voltage, and the drain of the first PMOS transistor is used as the second terminal of the second current mirror apparatus. The second PMOS transistor has a source used as the third terminal of the second current mirror apparatus and coupled to a source voltage, a drain used as the fourth terminal of the second current mirror apparatus, and a gate coupled to the gate of the first PMOS transistor.

In an embodiment of the present invention, the testing circuit includes a first current source, a second current source, a plurality of third switches, and a plurality of fourth switches. One terminal of the first current source is coupled to the source voltage for providing the testing current. One terminal of the second current source is coupled to the common level. Each of the above third switches has a first terminal, a second terminal, and a control terminal. The first terminals of the third switches are coupled to the other terminal of the first current source, and the second terminals of the third switches are respectively coupled to the 1st to the Nth nodes. Each of the above fourth switches has a first terminal, a second terminal, and a control terminal. The first terminals of the fourth switches are coupled to the other terminal of the second current source, and the second terminals of the fourth switches are respectively coupled to the 2nd to the N+1th nodes. The control terminal of one of the third switches and the control terminal of one of the fourth switches receive an enable signal for determining whether or not to turn on and transmitting the testing current to the light-emitting devices between the Ith node and the Jth node.

In the light source control method according to an embodiment of the present invention, the step of transmitting the testing current to the light-emitting devices between the Ith node and the Jth node includes transmitting the testing current to the Ith node, and sinking the testing current from the Jth node.

In an embodiment of the present invention, the step of providing the compensation current to the light-emitting devices between the Ith node and the Jth node includes providing the compensation current to the Ith node, and sinking the compensation current from the Jth node.

In the present invention, a current source and a plurality of switches are employed to fabricate a testing circuit to allow the testing current provided by the current source to pass through a loop formed by any two switches of the testing circuit and a random number of light-emitting devices connected in series, so that the testing current can be sent by means of using the control circuit to control the turning on of the switch, so as to measure the brightness of a random number of light-emitting devices connected in series.

Moreover, in the present invention, a digital-analog converter with a current mirror is employed to fabricate a digital-analog converting unit, and a digital-analog converting unit and a plurality of switches are used to fabricate a compensation unit, so as to allow the compensation current provided by the digital-analog converter to pass through the loop formed by any two switches of the compensation unit and a random number of light-emitting devices connected in series, so that the compensation current can be sent by means of using the control circuit to determine the magnitude of the compensation current according to the brightness of a random number of light-emitting devices connected in series and to control the turning on of the switch, thus compensating the brightness of a random number of light-emitting devices connected in series.

In order to make the aforementioned and other objectives, features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
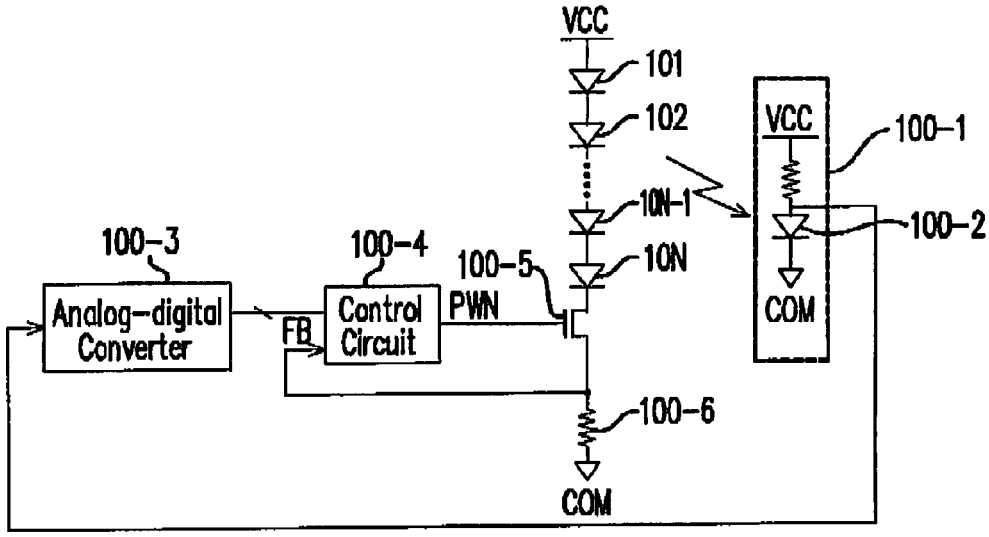
FIG. 1 (PRIOR ART)
FIG. 1 is a circuit diagram of a conventional LED control apparatus.
Figure 2:
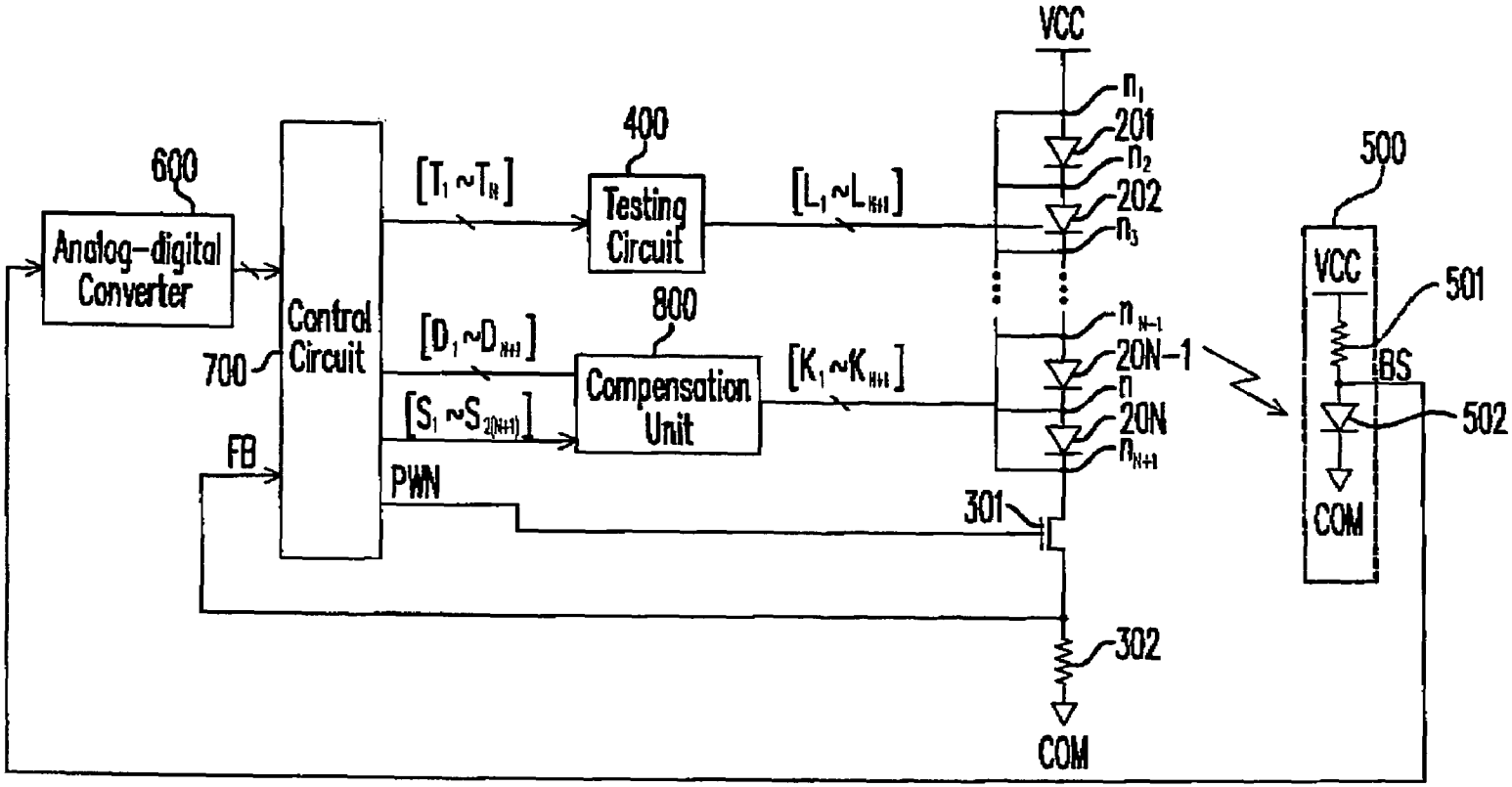
FIG. 2 is a circuit diagram of a light source control apparatus according to an embodiment of the present invention.

FIG. 2 is a circuit diagram of a light source control apparatus according to an embodiment of the present invention. The light source control apparatus is used to control the light-emitting brightness of the light-emitting devices 201-20N. In this embodiment, the above light-emitting devices are all implemented by LEDs which are coupled in the way as shown in FIG. 2, and the details will not be described. N+1 nodes are sequentially defined at two terminals of each light-emitting device, and are indicated by $n_1$-$n_{N+1}$, where, N is a natural number.

The above light source control apparatus includes a testing circuit 400 and a compensation circuit, and further includes a MOS transistor 301 and an impedor 302 (the operations of the MOS transistor 301 and the impedor 302 will be illustrated hereinafter). The testing circuit 400 is sequentially coupled to the nodes $n_1$-$n_{N+1}$ through the connection lines $L_1$-$L_{N+1}$ to transmit a testing current to light-emitting devices between Ith node and Jth node, where I and J are natural numbers, and N+1>=J>I>=1. The compensation circuit is coupled to the nodes $n_1$-$n_{N+1}$ sequentially through the connection lines $K_1$-$K_{N+1}$, so as to measure the brightness of the light-emitting devices between the Ith node and the Jth node, determine the value of the compensation current according to the intensity of the brightness, and provide the above compensation current to the light-emitting devices between the Ith node and the Jth node.

The compensation circuit includes a brightness measuring circuit 500, an analog-digital converter 600, a control circuit 700, aid a compensation unit 800. The compensation circuit 800 is coupled to the nodes $n_1$-$n_{N+1}$ sequentially through the connection lines $K_1$-$K_{N+1}$. The brightness measuring circuit 500 is employed to measure the brightness of the light-emitting devices between the Ith node and the Jth node, so as to generate a brightness indication sisal BS. Next, the analog-digital converter 600 is employed to convert the brightness indication signal BS from analog to digital, so as to provide the signal to the control circuit 700. Next, the control circuit 700 determines the value of the compensation current according to the brightness indication signal BS, and outputs a first compensation signal and a second compensation signal according to the value of the compensation current. The compensation unit 800 transmits the above compensation current to the light-emitting devices between the Ith node and the Jth node according to the first compensation signal, and sinks the compensation current flowing to the Jth node according to the second compensation signal.

It should be emphasized that if the control circuit 700 is capable of processing the analog signal, or has an analog-digital converter 600 built inside, the analog-digital converter 600 is not required to be disposed between the brightness measuring circuit 500 and the control circuit 700.

Moreover, the above brightness measuring circuit 500 can be implemented by an impedor 501 and a photosensitive diode 502. By using the coupling scheme shown in the figure, the photosensitive diode 502 after sensing light will generate a brightness indication signal BS at its anode. The aforementioned MOS transistor 301 has a source/drain coupled to the node $n_{N+1}$, and a gate receiving a regulating signal PWM output by the control circuit 700. Next, a control voltage is generated through a filter, so as to determine the turn-on level. The impedor 302 is implemented by a resistor, which has one terminal coupled to the other source/drain of the MOS transistor 301 for generating the feedback signal FB, and the other terminal coupled to a common level COM. Definitely the above regulating signal PWM is generated by the control circuit 700 according to the feedback signal FB. It can be known from the coupling relationship between the MOS transistor 301 and the impedor 302 that the two elements are mainly used to control the magnitude of the operating current of the light-emitting devices 201-20N.

Figure 3:
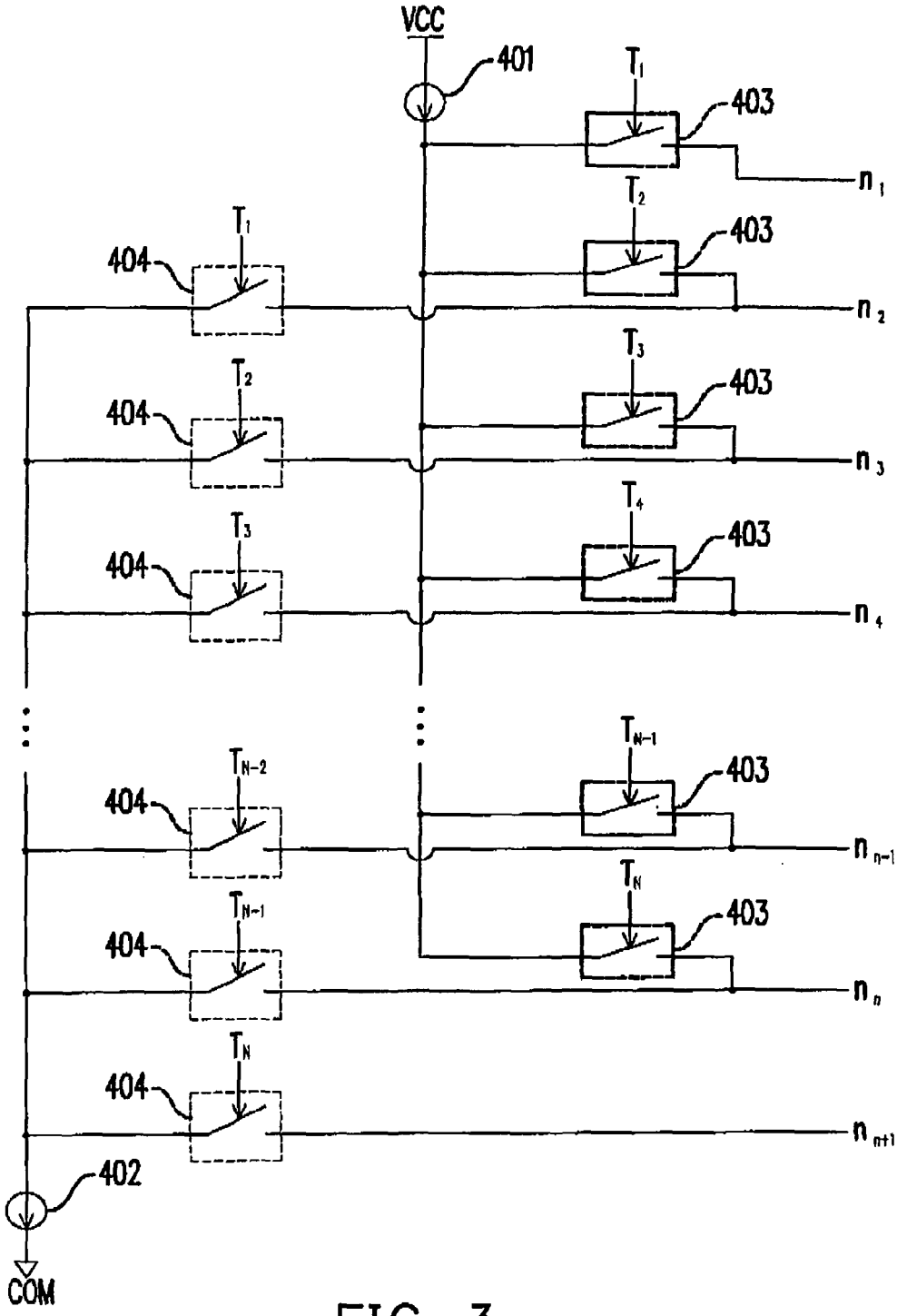
FIG. 3 is a circuit diagram of a testing circuit 400 according to an embodiment of the present invention.

After the primary circuit architecture of the light source control apparatus is illustrated, the internal structures of the testing circuit 400 and the compensation circuit 800 will be described in detail hereinafter. Referring to FIG. 3, the testing circuit 400 is first illustrated. FIG. 3 is a circuit diagram of a testing circuit 400 according to an embodiment of the present invention. The testing circuit 400 includes current sources 401, 402, and further includes N switches 403 and N switches 404, in which the current source 401 is used to provide the above testing circuit. The control terminals of the switches 403, 404 are all coupled to the control circuit 700 (in FIG. 2). The on or off state of the switches is determined according on one of the signals $T_1$-$T_N$ output by the control circuit 700. The coupling scheme of the other two terminals of the switches 403, 404 is also shown in FIG. 3, and the details will not be repeated again.

It should be noted that in this embodiment, the control terminals of the switch 403 coupled to the Ith node (e.g., node $n_1$) and the switch 404 coupled to the I+1th node (e.g., node $n_2$) receive the same signal (e.g., $T_1$). Therefore, if it is intended to transmit the testing current to the light-emitting device 201, only the signal $T_1$ of the control circuit 700 is required to be enabled. If it is intended to transmit the testing current to the light-emitting device 202, only the signal $T_2$ of the control circuit 700 is required to be enabled.

Definitely, the user can configure the signals received by the control terminals of the switches 403 and 404 freely according to the practical requirements, so as to test a random number of light-emitting devices connected in series. For example, the same signal is applied to the control terminals of the switch 403 coupled to the Ith node (e.g., node $n_2$) and the switch 404 coupled to the I+3th node (e.g., node $n_5$), so as to transmit the testing current to the light-emitting devices 202-204. Other configurations can be deduced by the user, and will not be described herein.

Figure 4:
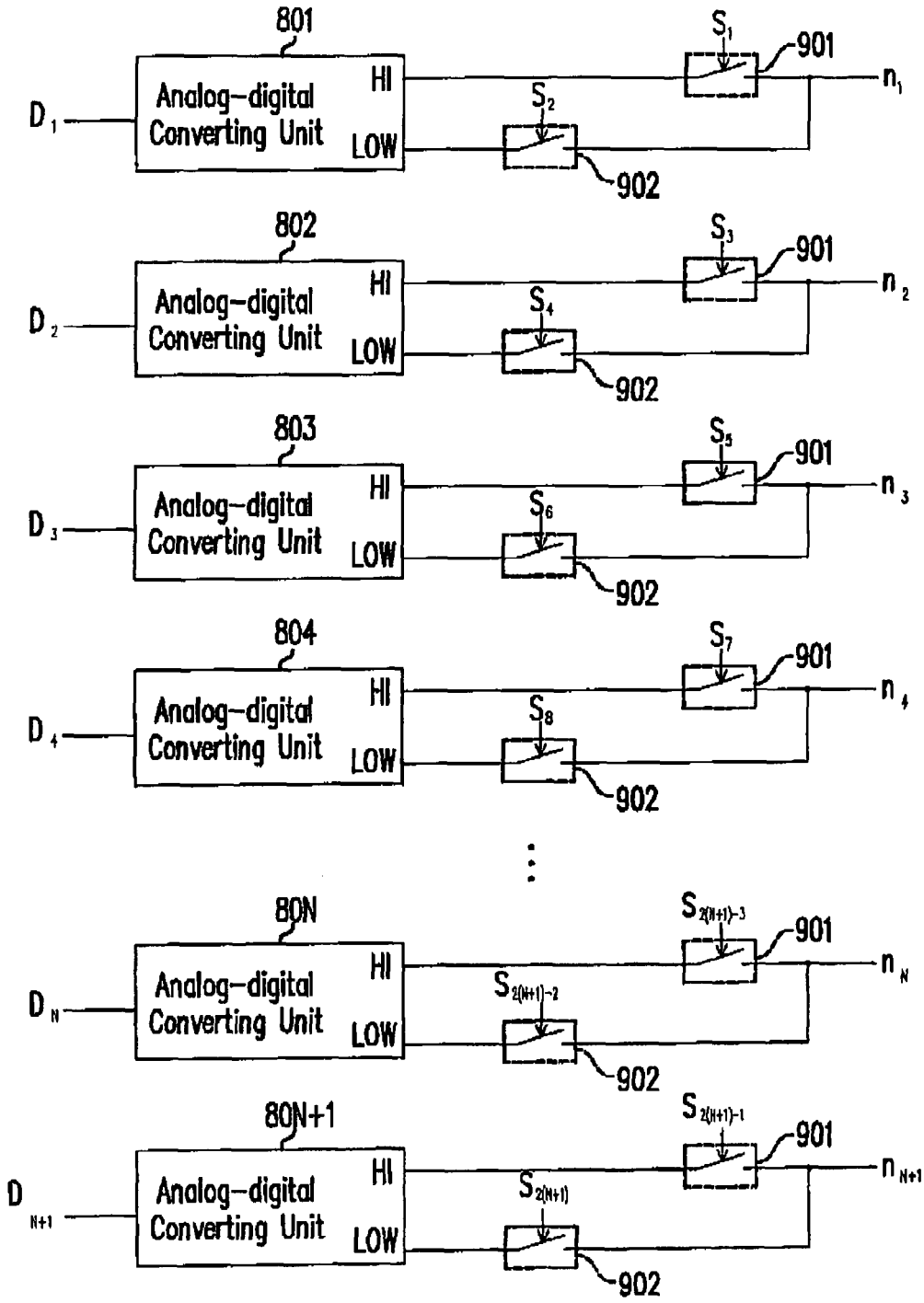
FIG. 4 is a circuit diagram of a compensation circuit 800 according to an embodiment of the present invention.

Next, referring to FIG. 4, the compensation circuit 800 is illustrated. FIG. 4 is a circuit diagram of a compensation circuit 800 according to an embodiment of the present invention. The compensation circuit 800 includes digital-analog converting units 801-80N+1, and further includes N+1 switches 901 and N+1 switches 902. Each of the above digital-analog converting units 801-80N+1 has an input terminal ($D_1$-$D_{N+1}$ respectively), an output terminal (HI), and a sinking terminal (LOW). The input terminals of the digital-analog converting unit are coupled to the control circuit 700 for determining the magnitude of the compensation current output by the output terminals and the magnitude of the current sunk by the sink terminals according to the signal received by the input terminals.

The control terminals of the switches 902 mid 902 are coupled to the control circuit 700 (shown in FIG. 2). The on or off state of the switches is determined according on one of the signals $S_1$-$S_{2(N+1)}$ output by the control circuit 700, and the coupling manner of the other two terminals of the switches 901 and 902 is also shown in FIG. 4, and thus the description thereof will not be repeated. Two of the digital-analog converting units respectively receive a first compensation signal and a second compensation signal. By controlling the on/off states of the switches 901 and 902, the digital-analog converting unit receiving the first compensation signal can transmit the compensation current to the light-emitting devices between the Ith node and the Jth node, and from the Jth node, the digital-analog converting unit receiving the second compensation signal can sink the compensation current flowing to the Jth node. The detailed operation is illustrated hereinafter.

Figure 5:
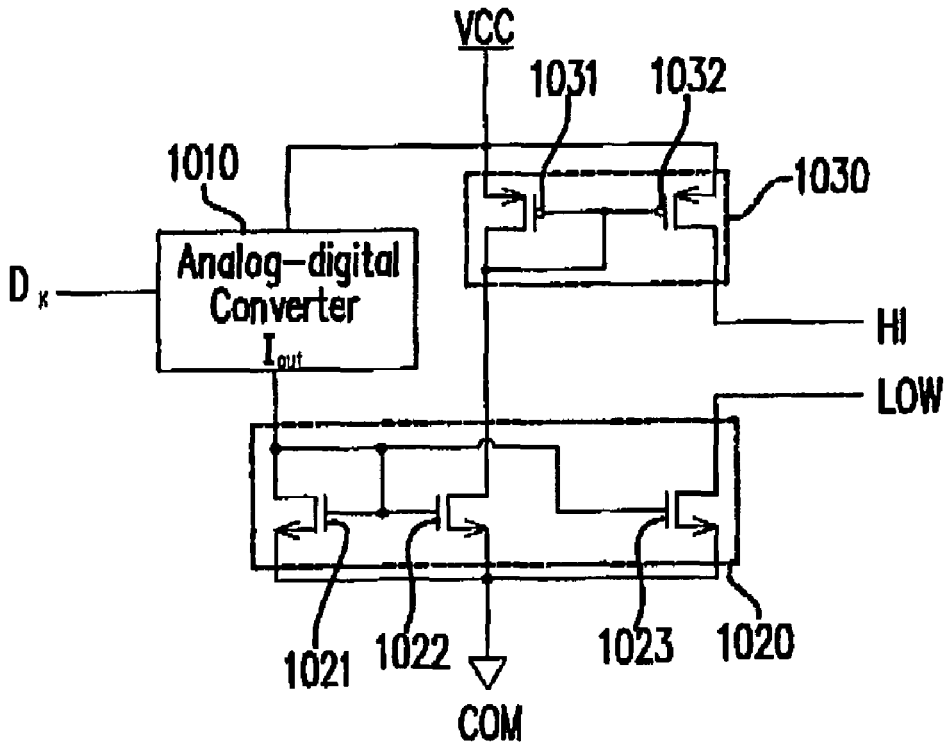
FIG. 5 is a circuit diagram of a digital-analog converting unit according to an embodiment of the present invention.

Referring to FIG. 5, the internal structure of each digital-analog converting unit is shown in FIG. 5. FIG. 5 is a circuit diagram of a digital-analog converting unit according to an embodiment of the present invention. The digital-analog converting unit includes a digital-analog converter 1010, and current mirror apparatuses 1020, 1030. The digital-analog converter has an input terminal ($D_K$) and an output terminal (Iout). The digital-analog converter determines the magnitude of the current output by the output terminal according to the signal received by the input terminal.

Moreover, in this embodiment, the current mirror apparatus 1020 is implemented by NMOS transistors 1021, 1022 and 1023, and the current mirror apparatus 1030 is implemented by PMOS transistors 1031 and 1032. The drain of the NMOS transistor 1023 is used as the sink terminal LOW of the digital-analog converting unit, and the drain of the PMOS transistor 1032 is used as the output terminal HI of the digital-analog converting unit. The coupling relationship between the NMOS transistors and the PMOS transistors is shown in FIG. 5, and the detailed description thereof will not be repeated. It can be known from the coupling manner of the current mirror apparatuses, the magnitude of the compensation current output by the output terminal HI and the magnitude of the current sunk by the sink terminal LOW are all controlled by the magnitude of the current output by the digital-analog converter.

Figure 6:
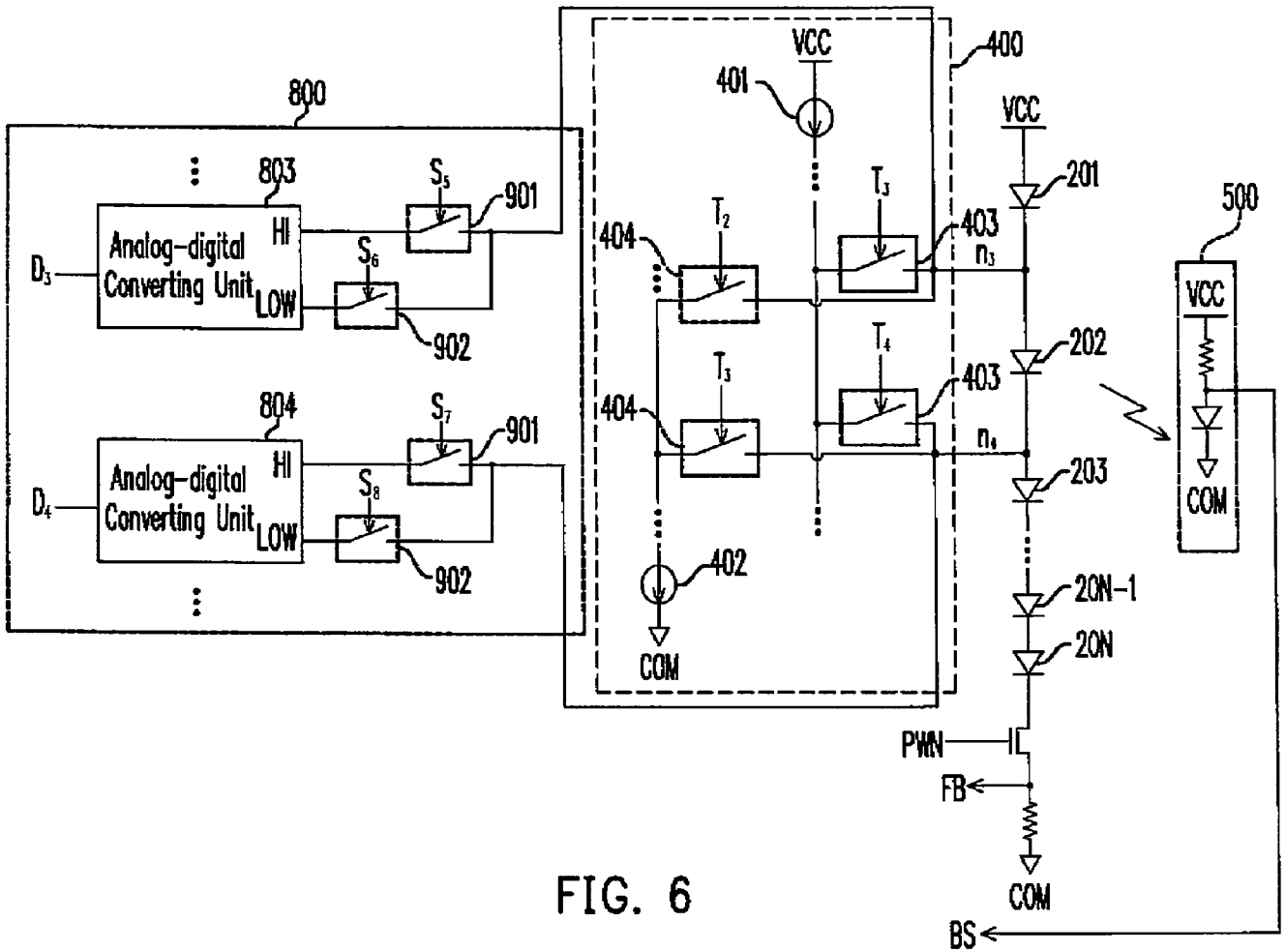
FIG. 6 is a schematic circuit diagram of the light source control apparatus illustrating the operating manner.

In order to make the operating method of the present invention understandable to those skilled in the art, for example, the testing and compensation of the brightness for the light-emitting device 203 are described, and the relevant circuits of the light-emitting device 203 in the testing circuit 400 and the compensation unit 800 are listed to simplify the description of the operation, as shown in FIG. 6.

FIG. 6 is a schematic circuit diagram of the light source control apparatus illustrating the operation thereof. Referring to FIG. 6, if the user intends to test the brightness of the light-emitting device 203, only the signal $T_3$ output by the control circuit 700 (not shown) is required to be enabled, so that the current passing through the light-emitting device 203 includes the original operation current together with the testing current. Thus, the light-emitting brightness of the light-emitting device 203 changes. The brightness measuring circuit 500 can measure the brightness of the light-emitting devices 201-20N. In other words, the brightness of the light-emitting device 203 is measured after changing. Furthermore, the measured brightness value is converted into digital value by an analog-digital converter 600 (not shown), and then transmitted to the control circuit 700. Next, the control circuit 700 compares the brightness of the light-emitting devices 201-20N with a predetermined brightness, so as to determine the magnitude of the compensation current.

After determining the magnitude of the compensation current, the control circuit 700 respectively outputs a first compensation signal and a second compensation signal to the input terminal $D_3$ of the digital-analog converting unit 803 and the input terminal $D_4$ of the digital-analog converting unit 804 according to the magnitude of the compensation current, and the switch 901 receiving $S_5$ and the switch 902 receiving $S_8$ are both turned on. As such, the digital-analog converting unit 803 outputs a compensation current to the node $n_3$, so as to compensate the brightness of the light-emitting device 203, and the digital-analog converting unit 804 also sink the compensation current flowing to the node $n_4$. It should be noted that the value range of the compensation current includes zero.

Moreover, the user can also test the brightness of the light-emitting devices 201-20N sequentially, so as to obtain N brightness indication signals. Next, the brightness differences of the brightness indication signals are compared by the control circuit 700. Next, a first compensation signal and a second compensation signal are sent to the corresponding digital-analog converting unit for the compensated light-emitting device. The on/off states of the switches 901 and 902 are controlled, so as to transmit the compensation current to the light-emitting device.

Figure 7:
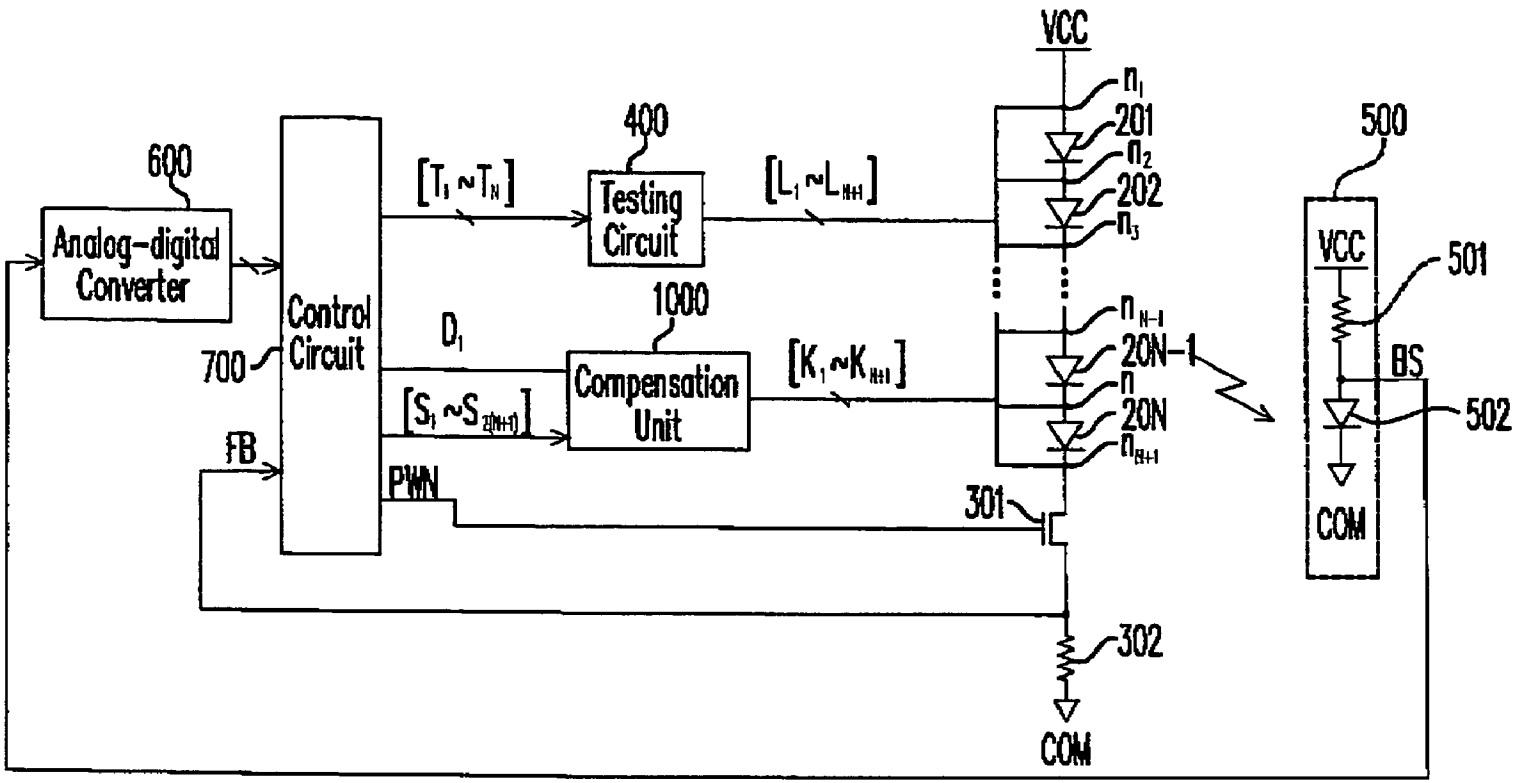
FIG. 7 is a circuit diagram of a light source control apparatus according to another embodiment of the present invention.

Based on the above teachings, persons skilled in the art should understand that the compensation unit can be implemented in various manners, and is not limited to the compensation unit 800 illustrated in FIG. 4. In order to make those skilled in the art to understand that the compensation unit can be implemented in various manners, another embodiment is illustrated where only one compensation signal is needed to compensate the brightness of the light-emitting device, as shown in FIG 7. FIG. 7 is a circuit diagram of a light source control apparatus according to another embodiment of the present invention. The compensation unit 1000 only needs one compensation signal. The compensation unit 1000 is implemented in the manner as shown in FIG. 8.

Figure 8:
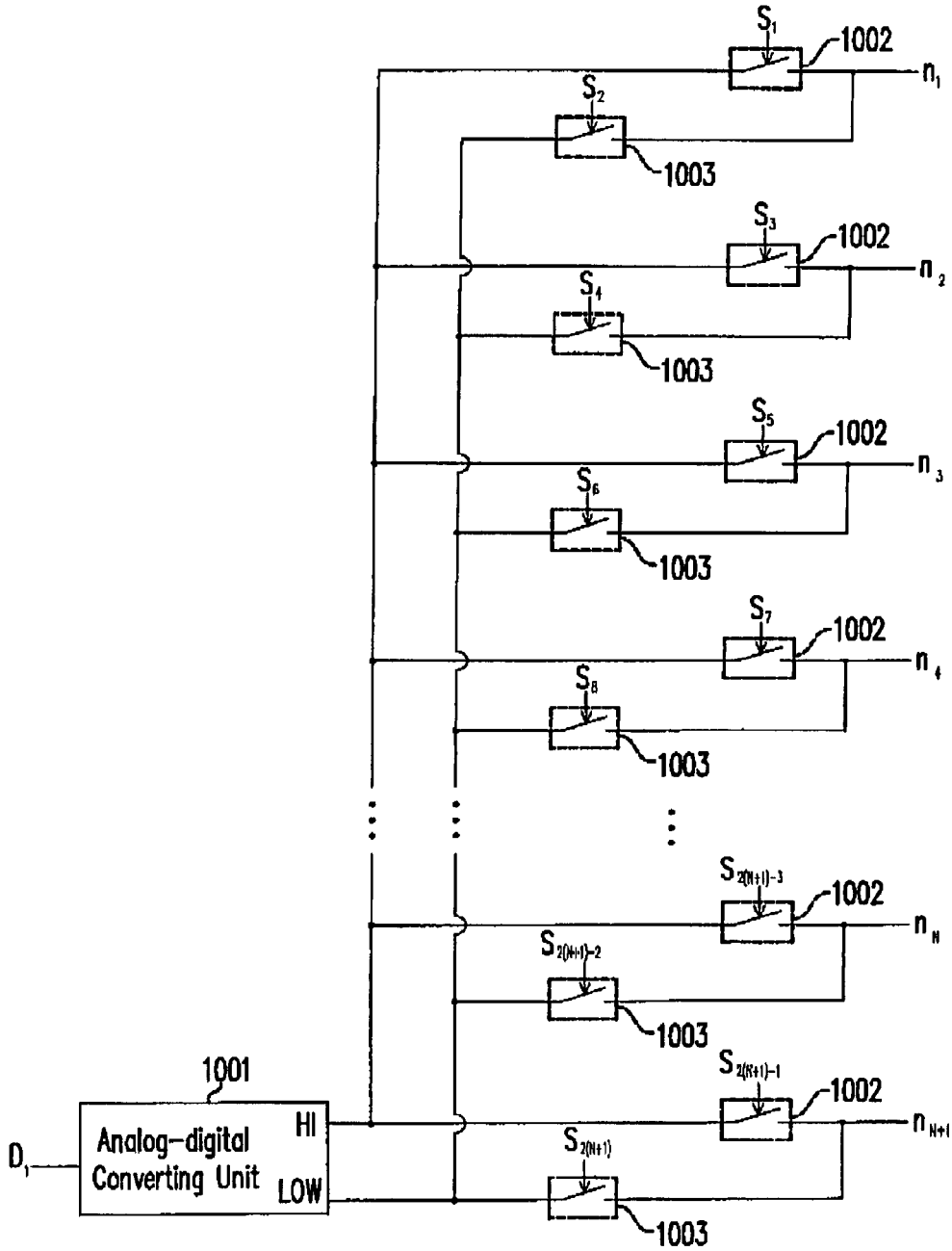
FIG. 8 is a circuit diagram of a compensation circuit 1000 according to an embodiment of the present invention.

FIG. 8 is a circuit diagram of a compensation circuit 1000 according to an embodiment of the present invention. The compensation unit 1000 includes a digital-analog converting unit 1001, N+1 switches 1002, and N+1 switches 1003. The input terminal (shown by $D_1$) of the digital-analog converting unit 1001 is coupled to the control circuit 700, and the internal structure is shown in FIG. 5, so the details of the operation and components will not be described herein. The control terminals of the switches 1002 and 1003 are coupled to the control circuit 700 for determining whether to turn on according to the signal received by the control terminals. The operation of the compensation unit 1000 is similar to that of the compensation unit 800, which can be deduced by the user, and the details will not be described herein again.

Figure 9:
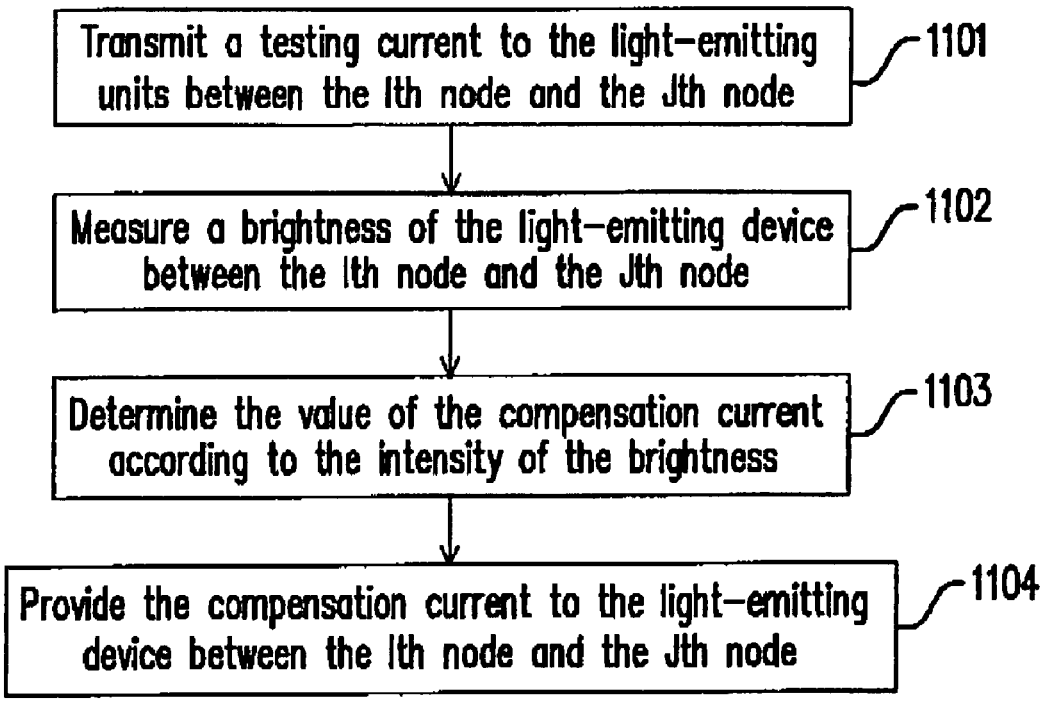
FIG. 9 is a flow chart of a light source control method according to an embodiment of the present invention.

Some basic operating methods of the present invention can be concluded from the description of the above embodiments, as shown in FIG. 9. FIG. 9 is a flow chart of a method of controlling the light source according to an embodiment of the present invention. Referring to FIG. 9, first, a testing current is transmitted to the light-emitting devices between the Ith node and the Jth node (Step 1101), where I and J are natural numbers and N+1>=J>I>=1. Next, the brightness of the light-emitting devices between the Ith node and the Jth node is measured (Step 1102). Next, the value of the compensation current is determined according to the intensity of the above brightness (Step 1103). Finally, the above compensation current is provided to the light-emitting devices between the Ith node and the Jth node (Step 1104).

The step of transmitting the testing current to the light-emitting devices between the Ith node and the Jth node (Step 1101) includes transmitting the testing current to the Ith node, and sinking the testing current at the Jth node. Based on the above conditions, the step of providing the compensation current to light-emitting devices between the Ith node and the Jth node (Step 1104) includes providing the compensation current to the Ith node, and sinking the compensation current at the Jth node. Moreover, the step of determining the value of the compensation current according to the intensity of the brightness includes comparing the measured brightness with a predetermined brightness, so as to determine the value of the compensation current.

Since in the present invention, a current source and a plurality of switches are employed to fabricate a testing circuit, the testing current provided by the current source can pass the loop formed by any two switches of the testing circuit and a random number of light-emitting devices coupled in series. Thus, the testing current can be sent by using the control circuit to turn-on the switch for measuring the brightness of a random number of light-emitting devices coupled in series.

Moreover, in the present invention, a digital-analog converter with a current mirror is employed to fabricate a digital-analog converting unit, and a digital-analog converting unit and a plurality of switches are used to fabricate a compensation unit, such that the compensation current provided by the digital-analog converter can pass the loop formed by any two switches of the compensation unit and a random number of light-emitting devices coupled in series. Thus, the compensation current can be sent by using the control circuit to determine the intensity of the compensation current according to the brightness of a random number of light-emitting devices coupled in series, and controlling the turning on of the switches, for compensating the brightness of a random number of light-emitting devices coupled in series.

Although the light-emitting devices in each embodiment are implemented by LEDs, LEDs arc only examples, but not intended to limit the present invention, such that the user can apply the technique of the present invention to other types of light-emitting devices according to the spirit of the present invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light source control apparatus, for controlling N light-emitting devices directly connected in series, wherein N+1 nodes are sequentially defined at two terminals of each light-emitting device, and each of the light-emitting devices is a light emitting diode, wherein N is a natural number and N is larger than 1, the light source control apparatus comprising:

a testing circuit, coupled to the N+1 nodes to transmit a testing current to light-emitting devices between Ith node and Jth node, wherein I and J are natural numbers, and N+1>=J>I>=1; and a compensation circuit, coupled to the N+1 nodes to measure a brightness of light-emitting devices between the Ith node and the Jth node, for deciding a value of a compensation current according to an intensity of brightness, and providing the compensation current to light-emitting devices between the Ith node and the Jth node, wherein the compensation circuit comprises:

a brightness measuring circuit, for measuring a brightness of the light-emitting devices between the Ith node and the Jth node, so as to generate a brightness indication signal;

a control circuit, for determining a value of the compensation current according to the brightness indication signal, and outputting a first compensation signal and a second compensation signal according to the value of the compensation current; and a compensation unit, coupled to the N+1 nodes to directly transmit the compensation current to the light-emitting devices between the Ith node and the Jth node according to the first compensation signal, and directly sink the compensation current flowing to the Jth node according to the second compensation signal.

2. The light source control apparatus as claimed in claim 1, wherein the compensation circuit comprises:

a plurality of digital-analog converting units, each having an input terminal, an output terminal, and a sink terminal, wherein the input terminal of each digital-analog converting unit is coupled to the control circuit, a magnitude of the compensation current output by the output terminal and a magnitude of the current sunk by the sink terminal are determined according to the signal received by the input terminal;

a plurality of first switches, each having a first terminal, a second terminal, and a control terminal, wherein the first terminals of the first switches are respectively coupled to the output terminals of the digital-analog converting units, the second terminals of the first switches are respectively coupled to the N+1 nodes, and the control terminals of the first switches are coupled to the control circuit, and on or off state of the first switches is determined according on the signal received by the control terminals; and a plurality of second switches, each having a first terminal, a second terminal, and a control terminal, wherein the first terminals of the second switches are respectively coupled to the sink terminals of the digital-analog converting units, the second terminals of the second switches are respectively coupled to the nodes, and the control terminals of the second switches are coupled to the control circuit, and on or off state of the second switches is determined according on the signal received by the control terminals, wherein the input terminals of two of the digital-analog converting units respectively receive the first compensation signal and the second compensation signal, and wherein the first switch corresponding to the digital-analog converting unit used for receiving the first compensation signal is turned on, and the second switch corresponding to the digital-analog converting unit used for receiving the second compensation signal is turned on.

3. The light source control apparatus as claimed in claim 2, wherein each digital-analog converting unit comprises:

a digital-analog converter, having an input terminal and an output terminal, wherein the digital-analog converter determines a magnitude of the current output by the output terminal according to the signal received by the input terminal;

a first current mirror apparatus, having a first terminal, a second terminal, a third terminal, a fourth terminal, a fifth terminal, and a sixth terminal, wherein the first terminal of the first current mirror apparatus receives the current output by the digital-analog converter, the first current mirror apparatus determines a value of the current of the third terminal and the fourth terminal and a value of the current of the fifth terminal and the sixth terminal according to the current flowing through the first terminal and the second terminal, and the fifth terminal of the first current mirror apparatus is used as the sink terminal of the digital-analog converting unit; and a second current mirror apparatus, having a first terminal, a second terminal, a third terminal, and a fourth terminal, wherein the second terminal of the second current mirror apparatus is coupled to the third terminal of the first current mirror apparatus, the fourth terminal of the second current mirror apparatus is used as the output terminal of the digital-analog converting unit, and the second current mirror apparatus determines a value of the current of the third terminal and the fourth terminal according to a current flowing through the first terminal and the second terminal.

4. The light source control apparatus as claimed in claim 3, wherein the first current mirror apparatus comprises:

a first NMOS transistor, having a drain and a gate connected to the drain, wherein the drain of the first NMOS transistor is used as the first terminal of the first current mirror apparatus, and a source of the first NMOS transistor is used as the second terminal of the first current mirror apparatus, and coupled to a common level;

a second NMOS transistor, having a drain used as the third terminal of the first current mirror apparatus, a source used as the fourth terminal of the first current mirror apparatus, and coupled to a common level, and a gate coupled to the gate of the first NMOS transistor; and a third NMOS transistor, having a drain used as the fifth terminal of the first current mirror apparatus, a source used as the sixth terminal of the first current mirror apparatus, and coupled to a common level, and a gate coupled to the gate of the first NMOS transistor.

5. The light source control apparatus as claimed in claim 3, wherein the second current mirror apparatus comprises:

a first PMOS transistor, having a drain and a gate connected to the drain, wherein a source of the first PMOS transistor is used as the first terminal of the second current mirror apparatus and coupled to a source voltage, and a drain of the first PMOS transistor is used as the second terminal of the second current mirror apparatus; and a second PMOS transistor, having a source used as the third terminal of the second current mirror apparatus and coupled to the source voltage, and a drain used as the fourth terminal of the second current mirror apparatus, and a gate coupled to the gate of the first PMOS transistor.

6. The light source control apparatus as claimed in claim 2, wherein the compensation circuit further comprises:

an analog-digital converter, coupled between the brightness measuring circuit and the control circuit, for converting the brightness indication signal from an analog state to a digital state.

7. The light source control apparatus as claimed in claim 1, wherein the testing circuit comprises:

a first current source, having one terminal coupled to a source voltage for providing the testing current;

a second current source, having one terminal coupled to a common level;

a plurality of third switches, each having a first terminal, a second terminal, and a control terminal, wherein the first terminals of the third switches are coupled to the other terminal of the first current source, and the second terminals of the third switches are respectively coupled to the 1st to the Nth nodes; and a plurality of fourth switches, each having a first terminal, a second terminal, and a control terminal, wherein the first terminals of the fourth switches are coupled to the other terminal of the second current source, and the second terminals of the fourth switches are respectively coupled to the 2nd to the N+1 th nodes, wherein the control terminal of one of the third switches and the control terminal of one of the fourth switches receive an enable signal so as to determine whether or not to turn on and transmit the testing current to the light-emitting devices between the Ith node and the Jth node.

8. The light source control apparatus as claimed in claim 1, further comprising:

a first MOS transistor, having a source/drain coupled to the N+1 node and a gate for receiving a regulating signal output by the control circuit, so as to determine the turn-on level; and a first impedor, having one terminal coupled to the other source/drain of the first MOS transistor and generating a feedback signal, and the other terminal coupled to a common level, wherein the control circuit generates the regulating signal according to the feedback signal.

9. The light source control apparatus as claimed in claim 8, wherein the regulating signal comprises a pulse width modulation (PWM) signal.

10. The light source control apparatus as claimed in claim 1, wherein the brightness measuring circuit comprises:

a second impedor, having one terminal coupled to a source voltage;

a photosensitive diode, having an anode coupled to the other terminal of the second impedor and generating the brightness indication signal, and a cathode coupled to a common level.

11. The light source control apparatus as claimed in claim 1, wherein the compensation circuit comprises:

a brightness measuring circuit, for measuring the brightness of the light-emitting devices between the Ith node and the Jth node, so as to generate a brightness indication signal;

a control circuit, determining a value of the compensation current according to the brightness indication signal, and outputting a first compensation signal according to the value of the compensation current; and a compensation unit, coupled to the nodes to transmit the compensation current to the light-emitting devices between the Ith node and the Jth node according to the compensation signal, and sink the compensation current flowing to the Jth node according to the compensation signal.

12. The light source control apparatus as claimed in claim 11, wherein the compensation circuit comprises:

a digital-analog converting unit, having an input terminal, an output terminal, and a sink terminal, wherein the input terminal of the digital-analog converting unit receives the compensation signal, so as to determine the magnitude of the compensation current output by the output terminal, and the magnitude of the current sunk by the sink terminal;

a plurality of fifth switches, each having a first terminal, a second terminal, and a control terminal, wherein the first terminals of the fifth switches are coupled to the output terminal of the digital-analog converting unit, the second terminals of the fifth switches are respectively coupled to the nodes, and the control terminals of the fifth switches are coupled to the control circuit, and on or off state of the fifth switches is determined according on the signal received by the control terminals; and a plurality of sixth switches, each having a first terminal, a second terminal, and a control terminal, wherein the first terminals of the sixth switches are coupled to the sink terminal of the digital-analog converting unit, the second terminals of the sixth switches are respectively coupled to the nodes, and the control terminals of the sixth switches are coupled to the control circuit, and on or off of the sixth switches is determined according the signal received by the control terminals, wherein the fifth switch coupled to the Ith node is turned on, and the sixth switch coupled to the Jth node is turned on.

13. The light source control apparatus as claimed in claim 1, wherein each of the light-emitting devices is an LED, and the LEDs are strung together from anode to cathode.

* * * * *